US009988999B2

(12) United States Patent
Ancimer et al.

(10) Patent No.: US 9,988,999 B2
(45) **Date of Patent: *Jun. 5, 2018**

(54) THERMAL MANAGEMENT FOR REGENERATING AN AFTERTREATMENT DEVICE

(71) Applicant: Cummins Inc., Columbus, IN (US)

(72) Inventors: Richard J. Ancimer, Toronto (CA); Axel Otto zur Loye, Columbus, IN (US); Arvind Suresh, Columbus, IN (US); Colin L. Norris, Columbus, IN (US)

(73) Assignee: Cummins Inc., Columbus, IN (US)

( * ) Notice: Subject to any disclaimer, the term of this patent is extended or adjusted under 35 U.S.C. 154(b) by 99 days.

This patent is subject to a terminal disclaimer.

(21) Appl. No.: 14/955,678

(22) Filed: Dec. 1, 2015

(65) Prior Publication Data

US 2016/0084182 A1 Mar. 24, 2016

Related U.S. Application Data

(63) Continuation of application No. 14/086,376, filed on Nov. 21, 2013, now Pat. No. 9,212,614.

(51) Int. Cl.

| | |
|---|---|
| ***F02D 41/02*** | (2006.01) |
| ***F02D 41/40*** | (2006.01) |
| ***F02D 13/06*** | (2006.01) |
| ***F02D 17/00*** | (2006.01) |
| ***F01N 3/023*** | (2006.01) |
| ***F02D 41/00*** | (2006.01) |

(52) U.S. Cl.

CPC ..... *F02D 41/027* (2013.01); *F01N 3/023* (2013.01); *F02D 13/06* (2013.01); *F02D 17/00* (2013.01); *F02D 41/0087* (2013.01); *F02D 41/029* (2013.01); *F02D 41/0002* (2013.01); *F02D 41/0007* (2013.01); *F02D 41/405* (2013.01); *F02D 2041/001* (2013.01)

(58) Field of Classification Search

CPC ..... F02D 13/06; F02D 17/00; F02D 41/0002; F02D 41/0007; F02D 41/0087; F02D 41/027; F02D 41/029; F02D 41/405; F02D 2041/001; F01N 3/023

See application file for complete search history.

(56) References Cited

U.S. PATENT DOCUMENTS

| | | | | |
|---|---|---|---|---|
| 5,063,736 | A | 11/1991 | Hough et al. | |
| 6,910,329 | B2 | 6/2005 | Bunting et al. | |
| 7,150,151 | B2 | 12/2006 | Mulloy et al. | |
| 7,207,176 | B2 | 4/2007 | Mulloy et al. | |
| 2004/0123589 | A1* | 7/2004 | Ohtake | F02D 41/029 60/295 |
| 2005/0188948 | A1 | 9/2005 | Miura | |

(Continued)

FOREIGN PATENT DOCUMENTS

| | | |
|---|---|---|
| JP | 2010112281 | 5/2010 |
| WO | 2009143258 | 5/2008 |

*Primary Examiner* — Audrey K Bradley

(74) *Attorney, Agent, or Firm* — Taft Stettinius & Hollister LLP

(57) ABSTRACT

A system and method for regeneration of an aftertreatment component are described. The disclosed method can employ any one or combination of operating modes that obtain a target condition of the exhaust gas to support or initiate regeneration of the aftertreatment device.

29 Claims, 3 Drawing Sheets

(56) References Cited

U.S. PATENT DOCUMENTS

| | | | | |
|---|---|---|---|---|
| 2007/0214772 | A1 | 9/2007 | England | |
| 2011/0072784 | A1* | 3/2011 | Hepburn | F01N 3/101 60/274 |
| 2014/0261315 | A1 | 9/2014 | Willard et al. | |

* cited by examiner

THERMAL MANAGEMENT FOR REGENERATING AN AFTERTREATMENT DEVICE

FIELD OF THE INVENTION

This disclosure relates generally to internal combustion engine operation, and more particularly to systems and methods of for regeneration of aftertreatment devices receiving exhaust gas produced by internal combustion engine operation.

BACKGROUND

Aftertreatment devices are well known and widely used in various internal combustion engine applications for the aftertreatment of engine exhaust gases. For example, devices such as diesel oxidation catalysts (DOC), diesel particulate filters (DPF) and selective catalytic reduction (SCR) devices have been useful for handling and/or removing controlled pollutants, including carbon monoxide, nitric oxide, unburned hydrocarbons, sulfur, and soot in the exhaust stream of an engine.

Particulate filter aftertreatment devices collect particulate matter such as soot from the exhaust gas. The accumulation of the particulate matter can cause an increase in back pressure in the exhaust system. Unless the particulate matter is removed, the accumulation of the particulate matter in the aftertreatment device can lead to fuel inefficiencies and/or uncontrolled exothermic reactions that could damage the aftertreatment device. In addition, the aftertreatment devices may be contaminated with reversible poisoning constituents such as sulphur-based constituents. These poisons reduce the performance of the aftertreatment devices, and non-compliance with emissions levels can result if these reversible poisons are not removed.

SUMMARY

A system and method for regeneration of an aftertreatment device that receives exhaust gas from operation of a multi-cylinder internal combustion engine are disclosed. While the systems and methods described herein have application in regeneration of aftertreatment devices such as DOC, DPF and SCR devices in an exhaust gas aftertreatment system, the methods can be used in other filter technologies to improve the effectiveness of regeneration of a filter or catalyst in non-diesel engines.

In some embodiments, the system in which the method is employed can include at least one aftertreatment device, an internal combustion engine including a plurality of cylinders for producing exhaust gas treated by the at least one aftertreatment device, at least one turbocharger and a fuelling system. The at least one aftertreatment device can include, for example, a catalyst and/or a particulate filter. The reciprocating engine can be a four-stroke engine. The turbocharger can include a wastegate to bypass a turbine or a variable geometry turbine with an adjustable inlet. Alternatively, the exhaust system can include an exhaust throttle. The fuel injector can be a common-rail type fuel injector, although other fuelling systems are also contemplated.

The systems and methods include selecting one or more regeneration modes of operation in which the at least one aftertreatment device is regenerated by obtaining a target condition of exhaust gas. The regeneration modes of operation can include a combustion phase retardation operating mode, a selected cylinder firing operating mode, a charge flow reduction operating mode, an engine output increase operating mode, an exhaust heating operating mode, and a hydrocarbon dosing operating mode.

The combustion phase retardation operating mode can include retarding the phasing of the combustion by manipulation of fuel injection events, or spark timing if a spark-ignited engine is used. The selected cylinder firing operating mode can include operating the engine on a subset of the plurality of cylinders to satisfy a torque request and, when employed with the combustion phase retardation operating mode, can allow even more retarded combustion phasing to produce higher exhaust temperatures than those produced by either mode in isolation.

The charge flow reduction operating mode includes reducing a flow rate of the charge flow to the plurality of cylinders to produce higher exhaust gas temperatures. The engine output adjustment operating mode can include adjusting an engine load or adjusting a speed of the engine to produce higher exhaust gas temperatures and exhaust flow rates. The exhaust heating operating mode can include operating an exhaust heater in the exhaust system or a fuel burner that burns and oxidizes hydrocarbons and provides the oxidized hydrocarbons to the exhaust gas. The hydrocarbon dosing mode of operation can include at least one of in-cylinder and external hydrocarbon dosing upstream of an oxidation catalyst so that the exothermic reaction of the hydrocarbons with the oxidation catalyst raises the exhaust gas temperatures.

This summary is provided to introduce a selection of concepts that are further described below in the illustrative embodiments. This summary is not intended to identify key or essential features of the claimed subject matter, nor is it intended to be used as an aid in limiting the scope of the claimed subject matter. Further embodiments, forms, objects, features, advantages, aspects, and benefits shall become apparent from the following description and drawings.

DETAILED DESCRIPTION

Figure 1A:
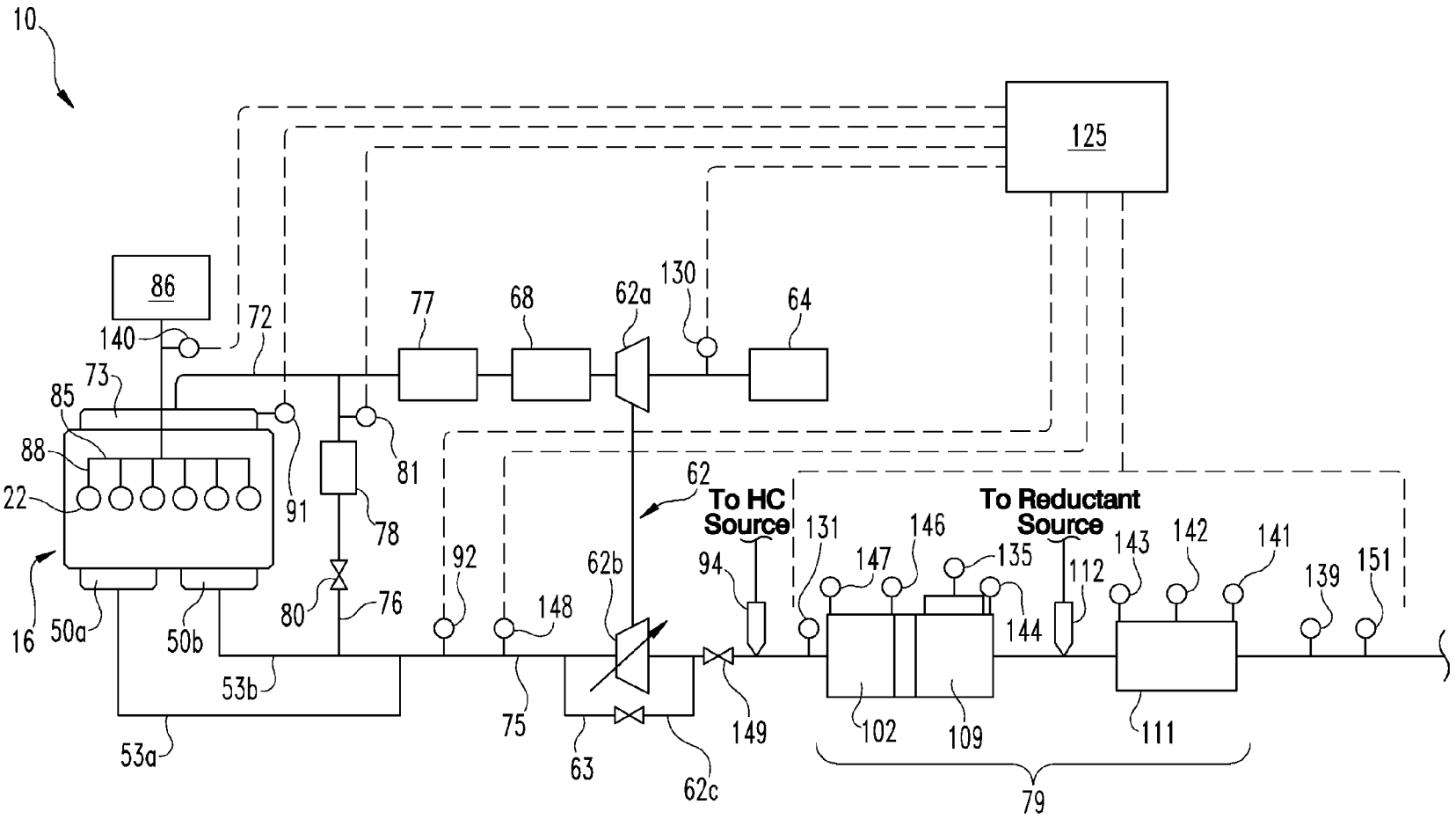
FIG. 1A shows one embodiment of an internal combustion engine that includes an aftertreatment system and in which the regeneration of at least one aftertreatment device is managed.

For the purposes of promoting an understanding of the principles of the invention, reference will now be made to the embodiments illustrated in the drawings and specific language will be used to describe the same. It will nevertheless be understood that no limitation of the scope of the invention is thereby intended, any alterations and further modifications in the illustrated embodiments, and any further applications of the principles of the invention as illustrated therein as would normally occur to one skilled in the art to which the invention relates are contemplated herein.

Figure 1B:
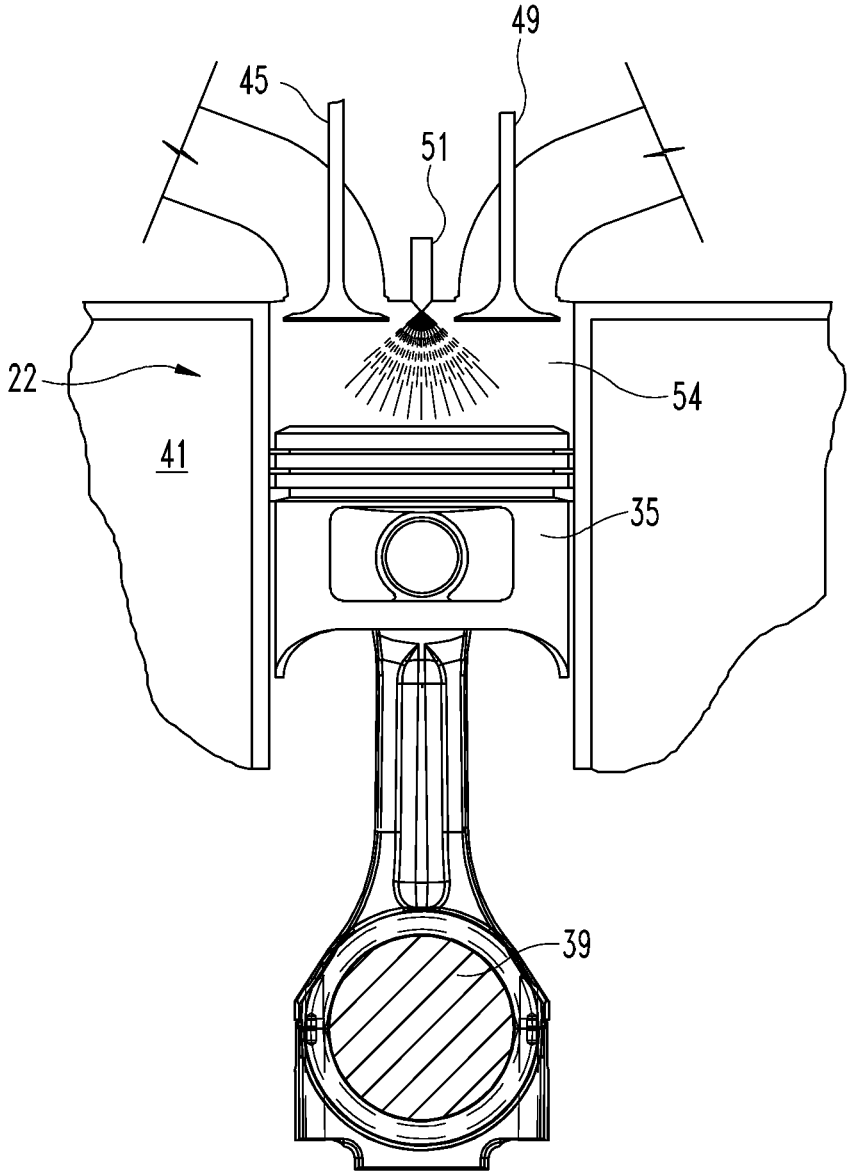
FIG. 1B is a schematic of a cylinder of the engine of the system of FIG. 1A.

With reference to FIG. 1A, a system 10 includes a four-stroke internal combustion engine 16. FIG. 1A illustrates an embodiment where the engine 16 is a diesel engine. The engine 16 can include a plurality of cylinders 22. FIG. 1A illustrates the plurality of cylinders 22 in an arrangement that includes six cylinders in an in-line arrangement for illustration purposes only. Any number of cylinders and any arrangement of the cylinders suitable for use in an internal combustion engine can be utilized. The number of cylinders 22 that can be used can range from one cylinder to eighteen or more. Furthermore, the following description at times will be in reference to one of the cylinders 22. It is to be realized that corresponding features in reference to the cylinder 22 described in FIG. 1B at other locations herein can be present for the other cylinders of engine 16.

The cylinder 22 houses a piston 35 that is operably attached to a crankshaft 39 that is rotated by reciprocal movement of piston 35 in cylinder 22. Within a cylinder head 41 of the cylinder 22, there is at least one intake valve 45, at least one exhaust valve 49 and a fuel injector 51 that provides fuel to a combustion chamber 54 formed by cylinder 22 between the piston 35 and the cylinder head 41. In other embodiment, fuel can be provided to combustion chamber 54 by port injection, or by injection in the intake system, upstream of combustion chamber 54.

The term "four-stroke" herein means the following four strokes—intake, compression, power, and exhaust—that the piston 35 completes during two separate revolutions of the engine's crankshaft 39. A stroke begins either at a top dead center (TDC) when the piston 35 is at the cylinder head 41 of the cylinder 22, or at a bottom dead center (BDC), when the piston 35 has reached its lowest point in the cylinder 22.

During the intake stroke, the piston 35 descends away from cylinder head 41 of the cylinder 22 to a bottom (not shown) of the cylinder, thereby reducing the pressure in the combustion chamber 54 of the cylinder 22. In the instance where the engine 16 is a diesel engine, a combustion charge is created in the combustion chamber 54 by an intake of air through the intake valve 45 when the intake valve 45 is opened.

The fuel from the fuel injector 51 is supplied by a high pressure common-rail system 85 that is connected to the fuel tank 86. Fuel from the fuel tank 86 is suctioned by a fuel pump (not shown) and fed to the common-rail system 85. The fuel fed from the fuel pump is accumulated in the common-rail system 85, and the accumulated fuel is supplied to the fuel injector 51 of each cylinder 22 through a fuel line 88. The accumulated fuel in common rail system can be pressurized to boost and control the fuel pressure of the fuel delivered to combustion chamber 54 of cylinders 22

During the compression stroke, both the intake valve 45 and the exhaust valve 49 are closed, the piston 35 returns toward TDC and fuel is injected near TDC in the compressed air, and the compressed fuel-air mixture ignites in the combustion chamber 54 after a short delay. In the instance where the engine 16 is a diesel engine, this results in the combustion charge being ignited. The ignition of the air and fuel causes a rapid increase in pressure in the combustion chamber 54, which is applied to the piston 35 during its power stroke toward the BDC. Combustion phasing in combustion chamber 54 is calibrated so that the increase in pressure in combustion chamber 54 pushes piston 35, providing a net positive in the force/work/power of piston 35. Retarding the combustion phasing increases exhaust gas temperatures since a portion of the combustion energy is released through the exhaust valves into the exhaust system.

During the exhaust stroke, the piston 35 is returned to the TDC while the exhaust valve 49 is open. This action discharges the burnt products of the combustion of the fuel in the combustion chamber 54 and expels the spent fuel-air mixture (exhaust gas) out through the exhaust valve 49.

The intake air flows through an intake passage 72 and intake manifold 73 before reaching the intake valve 45. The intake passage 72 is provided with an air cleaner 64, a compressor 62*a* of a turbocharger 62 and an optional intake air throttle 68. The intake air is purified by the air cleaner 64, compressed by the compressor 62*a* and then aspirated into the combustion chamber 54 through the intake air throttle 68. The intake air throttle 68 can be controlled to influence the air flow into the cylinder.

The intake passage 72 can be further provided with a cooler 77 that is provided downstream of the compressor 62*a*. In one example, the cooler 77 can be a charge air cooler (CAC). In this example, the compressor 62*a* can increase the temperature and pressure of the intake air, while the CAC 77 can increase a charge density and provide more air to the cylinders. In another example, the cooler 77 can be a low temperature aftercooler (LTA). The CAC 77 uses air as the cooling media, while the LTA uses coolant as the cooling media.

The exhaust gas flows out from the combustion chamber 54 into an exhaust passage 75 that is provided with a turbine 62*b* and a waste-gate 62*c* of the turbocharger 62 and then into an aftertreatment device 79. The exhaust gas that is discharged from the combustion chamber 54 drives the turbine 62*b* to rotate. The waste-gate 62*c* is a device that enables part of the exhaust gas to by-pass the turbine 62*b* through a passageway 63. Less exhaust gas energy is thereby available to the turbine 62*b*, leading to less power transfer to the air compressor 62*a*. Typically, this leads to reduced intake air pressure rise across the compressor 62*a* and lower intake air density/flow. The waste-gate 62*c* can be an open/close valve, or a full authority valve allowing control over the amount of by-pass flow or anything between. In another embodiment, turbine 62*b* is a variable geometry turbine with an adjustable inlet to the control the flow of exhaust gas therethrough. The exhaust passage 75 can further or alternatively include an exhaust throttle 149 for adjusting the flow of the exhaust gas through the exhaust passage 75. The exhaust gas, which can be a combination of by-passed and turbine flow, then enters the aftertreatment device 79.

Optionally, a part of the exhaust gas in the exhaust passage 75 can be recirculated into the intake air via an exhaust gas recirculation passage (EGR passage) 76. The EGR passage 76 connects the exhaust passage upstream of the turbine 62*b* to the intake passage 72 downstream of the intake air throttle 68. Alternatively or additionally, a low pressure EGR system (not shown) can be provided downstream of turbine 62*b* and upstream of compressor 62*a*. An exhaust gas recirculation valve (EGR valve) 80 for regulating the exhaust gas recirculation flow (EGR flow) is provided on the EGR passage 76. The EGR passage can be further provided with an EGR cooler 78 and a flow measurement device 81. Although not shown a bypass around EGR cooler 78 can also be provided. EGR passage 76 is shown connected to intake passage 72 downstream of CAC cooler 77, but can also be connected upstream of CAC cooler 77.

In one embodiment, exhaust gases are expelled into an common exhaust manifold. In the illustrated embodiment, the exhaust manifold is divided into two manifold portions 50*a*, 50*b* that receive exhaust gases from a respective first and second portions of the cylinders 22. The outlets 53*a*, 53*b* from the exhaust manifold portions 50*a*, 50*b* combine downstream of EGR passage 76 either upstream of turbine 62*b*, or at a singled inlet or a twin entry inlet to turbine 62*a*. Still other embodiment contemplate more than two exhaust manifold portions 50*a*, 50*b* dedicated to respective portions of the plurality of cylinders 22.

The aftertreatment device 79 herein means one or more devices useful for handling and/or removing material from exhaust gas that may be harmful constituents, including carbon monoxide, nitric oxide, nitrogen dioxide, hydrocarbons, and/or soot in the exhaust gas. In some examples, the aftertreatment device 79 can include at least one of a catalytic device and a particulate matter filter. The catalytic device can be a diesel oxidation catalyst (DOC) device, ammonia oxidation (AMOX) catalyst device, a selective catalytic reduction (SCR) device, three-way catalyst (TWC), lean NOX trap (LNT) etc. The reduction catalyst can include any suitable reduction catalysts, for example, a urea selective reduction catalyst. The particulate matter filter can be a diesel particulate filter (DPF), a partial flow particulate filter (PFF), etc. A PFF functions to capture the particulate matter in a portion of the flow; in contrast the entire exhaust gas volume passes through the particulate filter.

The arrangement of the components in the aftertreatment device 79 can be any arrangement that is suitable for use with the engine 16. For example, in one embodiment as shown in FIG. 1A, a DOC 102 and a DPF 109 are provided upstream of a SCR device 111. In one example, a reductant delivery device 112 is provided between the DPF 109 and the SCR device 111 for injecting a reductant into the exhaust gas upstream of SCR device 111. The reductant can be urea, diesel exhaust fluid, or any suitable reductant injected in liquid and/or gaseous form.

The exhaust passage 75 can further include a hydrocarbon (HC) injector 94 that is provided downstream of turbine 62*b* and upstream of DOC 102. The HC injector 94 can inject hydrocarbons, which can be, for example, fuel from fuel tank 86 or a secondary storage source of hydrocarbons. The hydrocarbons can be from any suitable hydrocarbon containing fluid or a reformate. In the example shown in FIG. 1A, the HC injector 94 and the aftertreatment device 79 are configured so that the fuel is dosed between an outlet of the turbine 62*b* and an inlet of DOC 102 upstream of the aftertreatment device 79. In this instance, the injection of the hydrocarbons can increase the temperature of the exhaust gas through oxidation of the injected hydrocarbons across the DOC 102 and the concomitant release of energy. In one example, injection occurs when the DOC 102 is sufficiently above the light-off temperature of the hydrocarbons to maintain hydrocarbon slip past the DOC 102 below an acceptable level.

In another embodiment, hydrocarbons are additionally or alternatively injected in-cylinder into one or more of the cylinders 22 through a direct injector connection with a hydrocarbon storage source or through a connection with common rail 85. The hydrocarbon injection into the cylinder combustion chambers 54 can occur at a late post injection fuel timing, for example after the injection of fuel to satisfy the torque request, where at least a portion of the late post injection hydrocarbons do not combust in cylinders 14 of engine 12. In one embodiment, the common rail fuel system is responsive to an in-cylinder HC dosing command from a controller 125 to inject an amount of hydrocarbons in-cylinder into one or more of the cylinders 22. In one embodiment, a first portion of cylinders 22 is connected to second exhaust manifold portion 50*b* that is connected to EGR passageway 76, which is connected to the intake passage 72 of engine 16. A second portion of cylinders 22 is connected to first exhaust manifold portion 50*a* which does not provide exhaust flow to EGR passage 76. In-cylinder dosing can be provided only to the second portion of cylinders 22 that do not provide exhaust flow to EGR passage 76, preventing injected hydrocarbons from being present in the EGR flow. In another embodiment with EGR, in-cylinder dosing can be provided to any cylinder 22. The fuel can be injected into the aftertreatment device 79 using any suitable methods known in the art, for example, by using a hydrocarbon injector for injecting diesel fuel, ethanol or gasoline into the exhaust passage 75 that is upstream of the aftertreatment device 79.

A controller 125 is provided to receive data as input from various sensors, and send command signals as output to various actuators. Some of the various sensors and actuators that may be employed are described in detail below. The controller 125 can include a processor, a memory, a clock, and an input/output (I/O) interface.

The sensors that can be provided include a mass air flow sensor (MAF) 130 that detects the amount of intake air, a differential pressure sensor 135 between an inlet and outlet of the DPF 109, temperature sensors 131 and 139 which detect the exhaust gas temperature upstream and downstream or at an inlet and outlet, respectively, of the aftertreatment device 79, an air/fuel (oxygen) sensor (not shown) which detects the air/fuel ratio of the air/fuel mixture supplied to the combustion chamber, a crank angle sensor (not shown) that detects a crank angle at intervals of a specified crank angle so as to detect the rotational angle position and the rotation speed of the crankshaft 39, and a pressure sensor 140 to detect the fuel pressure of the common rail 85 and/or fuel injector 51. Other sensors that can be provided include an intake manifold pressure and temperature sensor 91 for estimating an intake air flow using speed-density calculation (instead of a MAF), an exhaust pressure sensor 92, a DOC inlet temperature sensor 147, a DOC outlet temperature sensor 146, a DPF outlet temperature sensor 144, an SCR inlet temperature sensor 143, an SCR outlet temperature sensor 141, a mid-bed SCR temperature and/or $NH_3$ sensor 142, an engine out NOx sensor 148 for estimating urea dosing and a tail pipe NOx sensor 151 for diagnostics or closed loop urea dosing control.

The actuators that can be provided include actuators for opening and closing the intake valves 45, for opening and closing the exhaust valves 49, for injecting fuel from the fuel injector 51, for injecting hydrocarbons from the HC injector 94, for opening and closing the wastegate 62*c* or adjusting the inlet of a VGT, for EGR valve 80, for the intake air throttle 68, and for the exhaust throttle 149. The actuators are not illustrated in FIG. 1, but one skilled in the art would know how to implement the mechanism needed for each of the components to perform the intended function.

During operation, the controller 125 can receive information from the various sensors listed above through the I/O interface, process the received information using the processor based on an algorithm stored in the memory, and then send command signals to the various actuators through the I/O interface. For example, the controller 125 can receive information regarding a temperature input, process the temperature input, and then based on the temperature input and control strategy, send a command signal to one or more actuators to reduce NOx production and/or increase the exhaust gas temperature.

The controller 125 can be configured to implement the disclosed aftertreatment device regeneration method. In one embodiment, the disclosed method involves adjusting one or more operating conditions of engine 16 to increase the exhaust temperature and/or exhaust flow to achieve a target condition. The term "target condition" herein means a state of the system 10 during operation, such as the state of the exhaust gas within the exhaust passage 75 and can include the temperature of the exhaust gas, a flow rate of the exhaust gas, a ratio between an amount of $NO_2$ and an amount of particulate matter (PM) in the exhaust gas, an amount of oxygen across the oxidation catalyst, or other exhaust system parameters.

In one instance, one or more operating conditions are adjusted so as to achieve one or more target conditions of the exhaust gas. In some examples, the target conditions of the exhaust gas enable activation of regeneration of the aftertreatment device. Regeneration of the aftertreatment device means desorbing hydrocarbons and/or removing particulate matter and/or removing reversible poisons/aggregates accumulated in the aftertreatment device that can influence the performance or lead to damage of the aftertreatment device.

In other implementations, when the target condition for the exhaust gas is achieved, material from exhaust gas accumulated in the aftertreatment device 79 can be removed effectively. In some examples, the target condition for the exhaust gas is a target temperature of the exhaust gas at a particular position in the exhaust passageway 75. In one specific example, when the DOC 102 and DPF 109 are to be regenerated, the target temperature is a range of temperatures of the exhaust gas at the DOC 102 of the aftertreatment device 79.

In some instances, the target temperature is a range above about 200° C.; in this instance, any hydrocarbons adsorbed onto the catalysts will desorb. In another instance the target temperature is a range between 250° C. and 300° C.; in this instance the HC injection can be enabled to allow a higher target temperature downstream of the DOC 102. For example, the target temperature downstream at the DPF 109 can range from 400° C. to 600° C. At these temperatures, the soot oxidation rate on the DPF 109 increases to allow for regeneration of the DPF 109. Target temperatures can also be set for desulphation of the catalysts; desulphation temperatures depend on the catalyst formulation and can range from 400° C. to above 650° C., although lower temperature are possible with longer regeneration times. Target temperatures can also be set for the removal of urea based deposits. In some cases, temperatures at the SCR catalyst above 280° C. are sufficient to remove ammonia-sulphate based compounds. When hard urea deposits form, temperatures in excess of 400° C., and even in excess of 500° C. might be needed to remove the deposits in a timely manner.

In another embodiment, the predetermined target condition is a target ratio of an amount of $NO_2$ and an amount of particulate matter in the exhaust gas at a particular area of the exhaust passageway 75. In one example, the target ratio of an amount of $NO_2$ and an amount of particulate matter is in a range of about 20:1 or greater. For this particular target condition, the area of exhaust passageway of interest is at the inlet to the DPF 109 since the DPF inlet $NO_2$ flow rate, PM flow rate and temperature will determine the net soot oxidation rate for a particular embodiment of DPF configuration (i.e., formulation and size).

In some embodiments, one or more operation conditions are controlled to achieve one or more target conditions of the exhaust gas. For example, one or more operation conditions are controlled to achieve one or more of a target temperature range of the exhaust gas and a target amount of $NO_2$ and an amount of particulate matter. In one instance, one or more target conditions is both a target temperature range and an amount of $NO_2$ and an amount of particulate matter. In this instance, when one or more predetermined target conditions is reached, effective soot oxidation by $NO_2$ can be achieved in the aftertreatment device 79.

In another example, one or more target conditions is at least one of a target temperature range of the exhaust gas and a target amount of oxygen present in the exhaust gas upstream of the aftertreatment device 79. In one instance, one or more target conditions is both a target temperature range of the exhaust gas and a target amount of oxygen present in the exhaust gas upstream of the aftertreatment device 79. In this instance, when one or more target conditions is reached, effective oxidation by oxygen can be achieved in the aftertreatment device 79.

The control procedures implemented by the controller 125 to achieve the one or more target conditions will now be described. In general, the procedures described in FIG. 3 are executed by a processor of controller 125 executing program instructions (algorithms) stored in the memory of the controller 125. The description below can be implemented with system 10.

In certain embodiments, the system 10 further includes a controller 125 structured to perform certain operations to control system 10 in achieving one or more target conditions. In certain embodiments, the controller forms a portion of a processing subsystem including one or more computing devices having memory, processing, and communication hardware. The controller may be a single device or a distributed device, and the functions of the controller 125 may be performed by hardware or software.

In certain embodiments, the controller includes one or more modules structured to functionally execute the operations of the controller. The description herein including modules emphasizes the structural independence of the aspects of the controller, and illustrates one grouping of operations and responsibilities of the controller. Other groupings that execute similar overall operations are understood within the scope of the present application. Modules may be implemented in hardware and/or software on a non-transient computer readable storage medium, and modules may be distributed across various hardware or software components. More specific descriptions of certain embodiments of controller operations are included in the section referencing FIG. 2.

Certain operations described herein include operations to interpret one or more parameters. Interpreting, as utilized herein, includes receiving values by any method known in the art, including at least receiving values from a datalink or network communication, receiving an electronic signal (e.g. a voltage, frequency, current, or PWM signal) indicative of the value, receiving a software parameter indicative of the value, reading the value from a memory location on a non-transient computer readable storage medium, receiving the value as a run-time parameter by any means known in the art, and/or by receiving a value by which the interpreted parameter can be calculated, and/or by referencing a default value that is interpreted to be the parameter value.

Figure 2:
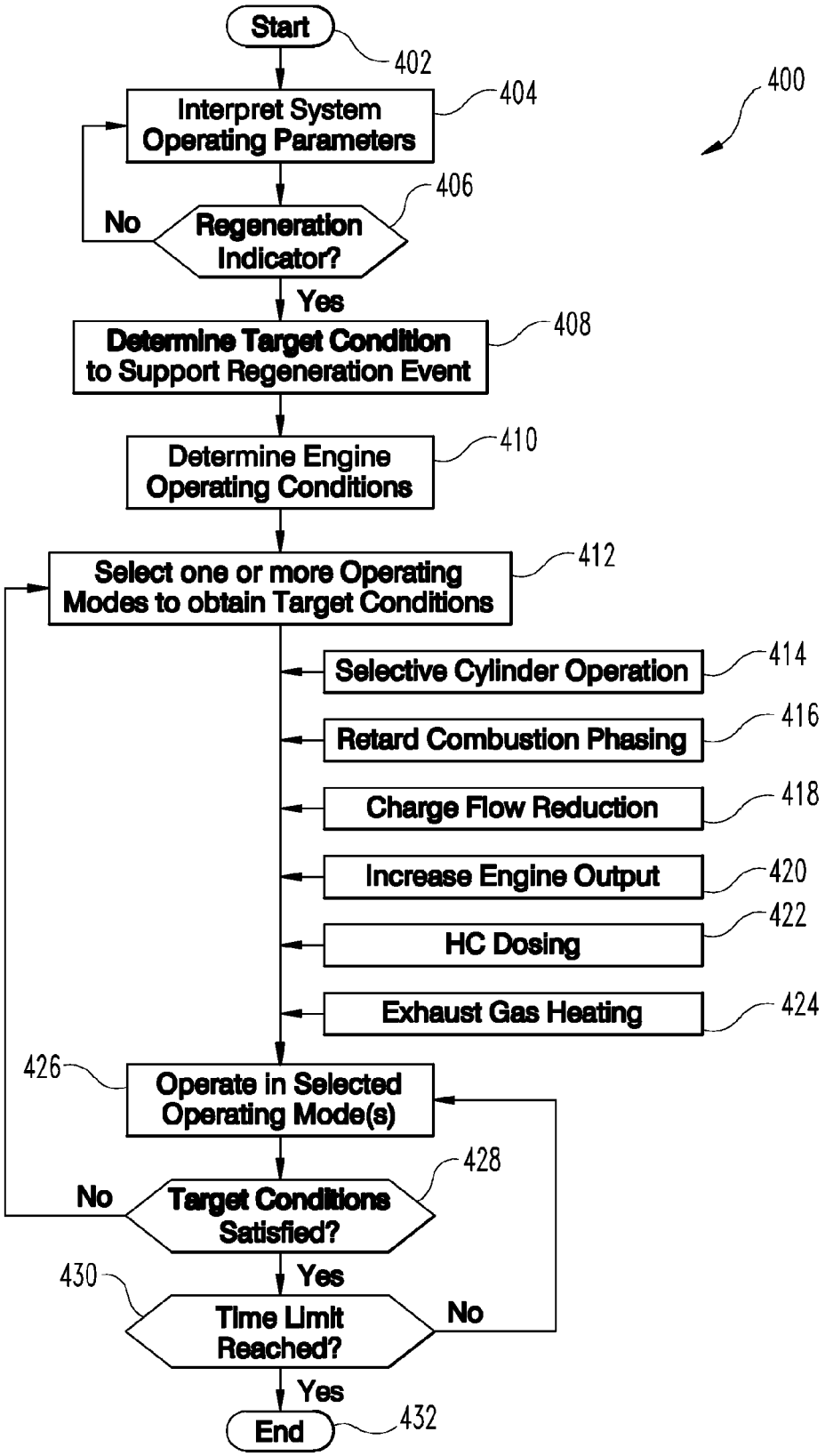
FIG. 2 shows a flow diagram of one embodiment of a procedure for regenerating an aftertreatment device.

With reference to FIG. 2, in one embodiment, the disclosed procedure 400 initiates at step 402 and can involve an operation 404 to interpret regeneration parameters regarding the condition of the aftertreatment device 79. The regeneration parameters can be, for example, a temperature at the inlet or other portion or portions of the aftertreatment device 79, a pressure drop across the aftertreatment device 79, a time since a last regeneration event, a catalyst and/or filter loading condition, an amount or estimate of particulate matter emitted from engine 16 since a last regeneration event, or any or other condition indicative of aftertreatment device performance that, when deficient, can be remedied through regeneration. The regeneration parameters can be indicative of any one or combination conditions, such as of hydrocarbon adsorption on the catalysts, soot or particulate accumulation on DPF 109, sulphur or other poisoning of one or more catalysts, and/or ammonia-sulphate based deposit accumulation.

In response to the interpretation of the regeneration parameters at operation 404, procedure 400 continues at conditional 406 to interpret the regeneration event and if regeneration event indicator for aftertreatment device 79 in response to the regeneration parameters is provided. Interpretation of the regeneration event can include determining the type of regeneration event in view of the condition or conditions of the aftertreatment device to be addressed, such as hydrocarbon adsorption, soot or particulate accumulation, sulphur or other poisoning, ammonia-sulphate based deposit accumulation, and/or a drop in deNOx efficiency of one or more catalysts. The indicator to initiate regeneration can be determined, for example, in response to regeneration parameters such as a temperature of aftertreatment device 79 exceeding a threshold at certain operating conditions, a pressure drop across the aftertreatment device 79 exceeding a threshold, a pressure at an inlet to aftertreatment device 79 exceeding a threshold, a time since a last regeneration event exceeding a threshold, a catalyst or filter loading condition exceeding a threshold, an amount or estimate of particulate matter emitted from engine 16 since a last regeneration event exceeding a threshold, an ammonia-sulphate deposit amount exceeding a threshold, or any or other condition indicating a regeneration event for aftertreatment device 79 is required or desirable. If a regeneration event is not indicated at conditional 406, procedure 400 returns to operation 404. If conditional 406 is positive, procedure 400 continues at operation 408.

Operation 408 includes determining target conditions of system 10 to support the indicated regeneration event. As discussed above, the target conditions can include, for example, at least one of a target temperature or target temperature range of the exhaust gas, or a target ratio of an amount of $NO_2$ and an amount of particulate matter in the exhaust gas at a particular area of the exhaust passageway 75, an amount of oxygen in the exhaust gas, and combinations of these. In one embodiment, the target conditions vary according to the type of regeneration event that is indicated for initiation.

Operation 410 includes interpreting current operating conditions of system 10. Interpreting current operating conditions can include, for example, determining an output torque and speed of engine 16, determining idle conditions of engine 16, determining an ambient temperature, determining an intake manifold temperature and pressure, determining a fresh air flow into the intake system, determining a mass flow rate or charge flow rate into cylinders 22 of engine 16, determining an exhaust flow rate, determining an EGR flow rate, determining a temperature of an aftertreatment component, and/or any other operating parameter.

Operation 412 includes selecting one or more engine operating modes at operations 414, 416, 418, 420, 422, 424 in response to the current operating conditions and the target operating conditions. In one embodiment, the selection of the engine operating mode is automatic once a particular regeneration event indicator is achieved. In another embodiment, the selection of engine operating modes can be prioritized, for example, in response to current engine operating conditions and the operating mode that most rapidly achieves the target condition based on the current engine operating condition, the distance of the current operating conditions from the target operating conditions, the most efficient operating mode based on current engine operating conditions, the operating mode that least impacts current operating conditions, or other criteria. One or more engine operating modes at operations 414, 416, 418, 420, 422, 424 is selected and executed so as to adjust current engine operating conditions to obtain the target conditions described above. The engine operation modes include selected cylinder firing 414, retarding cylinder combustion phasing 416, charge flow reduction 418, engine output increase 420, HC dosing 422, and exhaust gas heating 424.

Operation 414 includes selected cylinder operation in which a subset of cylinders 22 receive fuelling to satisfy a torque request. The subset of cylinders means a number of cylinders that is less than the total number of cylinders of engine 16. Operation 414 further includes providing fuelling to the subset of cylinders to satisfy the torque request while not fuelling or deactivating the remaining cylinders. Since less than all of cylinders 22 are fired, the temperature of the exhaust gas increases while the engine 16 is operating to satisfy the demand torque. In some implementations, operating the engine 16 on a subset of cylinders 22 involves deactivating the remaining cylinders 22. In one embodiment, the remaining cylinders 22 that are deactivated are connected to exhaust manifold portion 50*a* not flow connected to EGR passageway 76. The deactivated cylinders 22 can also or alternatively be selected to account for engine vibration effects by, for example, deactivating every other cylinder in the firing order. In another embodiment, at low load conditions, a larger number of cylinders can be deactivated than at higher load conditions. At high loads in which all cylinders are needed to satisfy the torque demand, operation 414 can be bypassed in favor of one other operations 416, 418, 420, 422,424 to obtain the target condition.

In some embodiment, deactivation of one or more of the cylinders 22 can involve disabling air flow and/or fuel flow to the cylinder 22. Disabling air flow and/or fuel flow to the cylinder 22 can involve disabling the intake valve 45, the exhaust valve 49 and/or the fuel injector 51. Valve disablement can be accomplished by control of a variable valve actuating mechanism (not shown) connected to the intake and/or exhaust valves. There could also be additional valves in the intake system or fuel system to disable intake flow or fuel flow to a subset of cylinders.

Operation 416 includes an operation mode to retard the combustion phasing in one or more of cylinders 22. The combustion phasing is a measure of when the combustion of the fuel that is injected as part of a normal fuel injection event burns during the four strokes that the piston 35 completes during two separate revolutions of the engine's crankshaft 39. The normal fuel injection event can be selected, for example, from a set of engine parameter operating maps as a function of engine speed and torque demand, and the main injection timing and quantity, pilot and post injection timing and quantity, and the rail pressure and can be calibrated as a function of engine speed and load. Retarding of the combustion phasing involves manipulating the fuel injection events or reducing the rail pressure in common rail 85 to delay the timing of the heat release thereby increasing the exhaust temperature. Operation 416 can be in addition to or alternatively to operation 414, depending on the engine load and target conditions. When all cylinders 22 are active and receiving fuelling, retarding the combustion phasing can be employed with all cylinders 22, or with a subset of cylinders 22. When only a subset of cylinders 22 are active in response to operation 414, retarding of combustion phasing can be employed on all of the subset of active cylinders 22, or on a portion of the active cylinders 22.

In addition to retarding the combustion phasing of the normal fuel injection event, one or more additional injection events can be added to the normal fuel injection event. An addition of a pilot injection of fuel before the main fuel injection event can increase stability of the retarded combustion phasing event. Also, an addition of post fuel injection event after the main injection event can further retard the average combustion phasing and further increase the exhaust temperatures.

At operation 418 a charge flow reduction mode of operation is selected in addition to one or more of operations 414, 416 or alternatively to operations 414, 416. The charge flow reduction operation includes lowering a rate of the fresh air flow into cylinders 22 to increase the exhaust gas temperature. The term "charge flow" herein means a flow of air and recirculated exhaust gas flows into the cylinder 32. Reducing a rate of fresh air flow at the same power level lowers the air to fuel ratio in cylinders 22, thereby, in general, resulting in an increase in the exhaust temperature.

In one example, lowering a rate of charge flow includes opening the wastegate 62*c*, thereby reducing the available exhaust energy that flows into the turbine; this reduces the power to the compressor and generally leads reduced air flow into the engine. In another example, the intake air throttle 68 is partially closed to reduce the density of the charge flow entering the engine, again leading to reduced charge flow. In another example, exhaust throttle 149 is closed to reduce the charge flow. In yet another example, one of the cylinders of the engine 16 is deactivated so as to reduce the intake air flow since engine 16, acting as a constant volume displacement pump, will reduce the charge flow at the same intake manifold pressure. In yet another example, the turbocharger 62, e.g., where the turbocharger 62 is a VGT, is manipulated in such a way that the turbine efficiency is degraded and less power is transferred to the compressor leading to a reduced air flow into the engine.

At operation 420 an engine output adjustment is selected in addition to one or more of operations 414, 416, 418 or alternatively to operations 414, 416, 418. Operation 420 includes increasing the engine load and/or engine speed. Increasing the engine speed (rpm) can raise accessory and/or friction loads, thereby increasing exhaust gas temperature and an amount of heat that is delivered to the aftertreatment device 79. In some examples, the air-to-fuel ratio is maintained or reduced while the engine speed is increased. Increasing the engine speed can increase the friction losses, i.e., friction mean effective pressure (FMEP), resulting in an increase in fuelling per engine cycle. In some instances, this can lead to an increase in the thermal energy to the exhaust gases. The engine speed can be increased by commanding a higher target engine speed when under idle speed governor mode; otherwise the transmission can be shifted into a gear that provides higher engine speed.

The engine output adjustment mode can also include increasing an engine load externally or parasitically. An external or parasitic engine load can increase the required fuelling per engine cycle, which can thereby increase the thermal energy to the exhaust system. An external engine load can be increased by adding an electric load or hydraulic load that is satisfied by operating the engine. A parasitic engine load can be increased by, for example, turning on a cooling fan or a hydraulic pump that is operated by the engine.

At operation 422 a HC dosing mode of operation is selected in addition to one or more of operations 414, 416, 418, 420 or alternatively to operations 414, 416, 418, 420. The HC dosing mode of operation can include in-cylinder HC dosing or external HC dosing with HC injector 94. External HC dosing can use an external HC source for injection, a reformation, or the fuel used for engine operation. In-cylinder HC dosing can use the fuel used for engine operation. In one embodiment, the quantity of hydrocarbons dosed is determined to obtain a target condition that corresponds to an outlet temperature of DOC 102. The quantity of HC dosing could be determined by closed loop feedback control based on DOC outlet temperature, or could also be based on an open loop estimation. Appropriate limits to the HC dosing amount can be applied to prevent high HC slip based on DOC temperature and exhaust flow rate. In addition, the HC dosing mode of operation can require a set of enable conditions, such as the DOC 102 being above a light-off temperature. The dosed hydrocarbons oxidize across the DOC 102 and the exothermic reaction increases the exhaust gas temperature.

In-cylinder HC dosing can be employed on all or a subset of the cylinders 22. In one embodiment, in-cylinder HC dosing is employed only on cylinders 22 connected with first exhaust manifold 50*a* to prevent hydrocarbon recirculation back to the intake system. In systems without EGR, in-cylinder HC dosing can be performed on all cylinders or a subset of cylinders. Operating in-cylinder dosing on a subset of cylinders can avoid fuel system limitations that might otherwise prevent stable fuel quantity control. If the selected cylinder firing mode of operation 414 is also active, the in-cylinder HC dosing can be performed in only the inactive, non-firing cylinders to prevent extreme exhaust port temperatures from occurring. When dosing in inactive cylinders, the HC injection can occur early in the power stroke to ensure in-cylinders temperatures support HC vaporization but not combustion, such as between 45-180 degrees after top dead center. In addition, the HC dosing can occur over multiple injection events to facilitate HC vaporization.

In another embodiment, the active and inactive cylinders in operating mode 414 can be rotated during the HC dosing mode of operation 422 to maintain average exhaust port temperatures at acceptable levels. In this case, in-cylinder HC dosing can be performed in a subset of cylinders that includes both active and non-active cylinders.

In another embodiment of in-cylinder HC dosing mode of operation 422, the HC dosing occurs early in the compression stroke, such as at 90 degrees before top dead center, or during the intake stroke, of an inactive cylinder. The HC dosing is timed so the injected HCs mix out of the air-fuel mixture sufficiently to avoid combustion during the compression and expansion stroke, but the HCs pre-react to oxidize more readily over the DOC 102.

At operation 424 an exhaust heating mode of operation is selected in addition to one or more of operations 414, 416, 418, 420, 422 or alternatively to operations 414, 416, 418, 420, 422. In one embodiment, the exhaust heating mode includes operating a heater in the exhaust system, such as an electric heater or fuel burner. The exhaust heater or fuel burner allows increase in exhaust temperatures independently of the operating conditions of engine 16, such as speed, load, combustion phasing, and charge flow. In other embodiments, operation 424 occurs in conjunction with at least operation 420 and the electric heater is operated by the engine 16, which increases the load on engine 16 to further increase exhaust gas temperatures.

After selection of the mode or modes of operation, procedure 400 continues at operation 426 to operate system 10 in the one or more modes of operation 414, 416, 418, 420, 422, 424 to obtain and remain at the target condition. While operating to obtain and remain in the target condition to regenerate the aftertreatment device, procedure 400 continues at conditional 428 to determine if the target conditions are satisfied. If condition 428 is negative, procedure 400 returns to operation 412 to select and/or de-select one or more of the operating modes 414, 416, 418, 420, 422, 424 to obtain the target condition. If conditional 428 is negative, operation 428 continues for a predetermined length of time determined to complete regeneration of the aftertreatment device 79 in response to the regeneration event that is indicated. The time limit for regeneration operation can vary in response to the target condition selected for regeneration. For example, hydrocarbon and water desorption can remedied by longer periods of operation at lower target operating temperatures, and therefore the mode or modes of operation selected for these conditions can operate for longer periods of time than other conditions which require extremely high exhaust temperatures for regeneration.

After the time limit for the regeneration mode of operation is elapsed, operating conditions can be measured to determine if the regeneration event was successful. For examples, the regeneration parameters that triggered the regeneration event can be determined and compared to the regeneration parameters prior to the regeneration event. If the difference does not exceed a threshold amount, an indication that the regeneration event was not successful can be provided by setting a fault flag or other indicator. In response to one or more fault flags, an onboard diagnostic output, de-rate of engine 16, or other indicator can be provided to indicate that corrective actions for aftertreatment device 79 are needed.

While the invention has been illustrated and described in detail in the drawings and foregoing description, the same is to be considered as illustrative and not restrictive in character, it being understood that only certain exemplary embodiments have been shown and described. Those skilled in the art will appreciate that many modifications are possible in the example embodiments without materially departing from this invention. Accordingly, all such modifications are intended to be included within the scope of this disclosure as defined in the following claims.

In reading the claims, it is intended that when words such as "a," "an," "at least one," or "at least one portion" are used there is no intention to limit the claim to only one item unless specifically stated to the contrary in the claim. When the language "at least a portion" and/or "a portion" is used the item can include a portion and/or the entire item unless specifically stated to the contrary.

What is claimed is:

1. A system, comprising:

an internal combustion engine including a plurality of cylinders that receive a charge flow from an intake system, an exhaust system for receiving exhaust gas produced by combustion of a fuel provided to at least a portion of the plurality of cylinders from a fuelling system in response to a torque request, and at least one aftertreatment device in the exhaust system;

a plurality of sensors operable to provide signals indicating operating conditions of the engine, the intake system, the fuelling system, the exhaust system, and the at least one aftertreatment device;

a controller connected to the plurality of sensors operable to interpret the signals from the plurality of sensors, wherein the controller is configured to:

determine a regeneration event indication for the at least one aftertreatment device in response to one or more regeneration parameters associated with the aftertreatment device;

determine a target condition of the exhaust gas in response to the regeneration event indication, wherein the target condition is effective to regenerate the aftertreatment device; and obtain the target condition by fuelling a subset of the plurality of cylinders while preventing fuelling to a remaining number of the plurality of cylinders in response to the torque request, and by selecting at least one operating mode, wherein selecting the at least one operating mode is prioritized in response to determining the operating mode that most rapidly obtains the target condition.

2. The system of claim 1, wherein the controller is further configured to select the at least one operating mode from the following: retarding a combustion phasing of the subset of the plurality of cylinders; reducing the charge flow to the plurality of cylinders; increasing an output of at least one of a speed and a torque of the engine; and dosing hydrocarbons upstream of the aftertreatment device.

3. The system of claim 1, wherein the controller is further configured to obtain the target condition by in-cylinder dosing of hydrocarbons in the remaining number of the plurality of cylinders for oxidation of the hydrocarbons in the exhaust system to increase a temperature of the exhaust gas.

4. The system of claim 1, wherein the regeneration event indication includes at least one of a hydrocarbon adsorption on the aftertreatment device, soot or particulate accumulation on the aftertreatment device, a sulphur poisoning of the aftertreatment device, and an ammonia-sulphate based deposit accumulation on the aftertreatment device.

5. The system of claim 1, wherein the controller is further configured to prioritize the selection of the at least one operating mode in response to the operating conditions.

6. A method, comprising:

operating an internal combustion engine system including an internal combustion engine with a plurality of cylinders that receive a charge flow from an intake system, an exhaust system for receiving exhaust gas produced by combustion of a fuel provided to at least a portion of the plurality of cylinders from a fuelling system in response to a torque request, and at least one aftertreatment device in the exhaust system;

determining a regeneration event indication for the at least one aftertreatment device by interpreting one or more regeneration parameters;

determining a target condition of the exhaust gas in response to the regeneration event indication, the target condition effective to regenerate the at least one aftertreatment device; and operating the internal combustion engine to obtain the target condition, wherein the target condition is obtained by fuelling a subset of the plurality of cylinders to satisfy the torque request, and selecting at least one operating mode from the following: retarding a combustion phasing to the subset of the plurality of cylinders; reducing the charge flow to the plurality of cylinders; increasing an output of at least one of a speed and a torque of the engine; and dosing hydrocarbons upstream of the aftertreatment device, wherein selecting the at least one operating mode is prioritized in response to determining the operating mode that most rapidly obtains the target condition.

7. The method of claim 6, wherein the selected operating mode includes increasing the output of at least one of the speed and the torque of the internal combustion engine.

8. The method of claim 6, wherein the selected operating mode includes retarding the combustion phasing of the subset of the plurality of cylinders and reducing the charge flow to the plurality of cylinders.

9. The method of claim 6, wherein the selected operating mode includes retarding the combustion phasing of the subset of the plurality of cylinders and increasing the output of at least one of the speed and the torque of the engine.

10. The method of claim 6, wherein the selected operating mode includes retarding the combustion phasing of the subset of the plurality of cylinders and dosing hydrocarbons upstream of the aftertreatment device.

11. The method of claim 6, wherein the aftertreatment device includes a selective catalytic reduction catalyst.

12. The method of claim 6, wherein the target condition includes a temperature of the exhaust gas.

13. The method of claim 6, wherein the regeneration event indication includes at least one of a hydrocarbon adsorption on the aftertreatment device, soot or particulate accumulation on the aftertreatment device, a sulphur poisoning of the aftertreatment device, and an ammonia-sulphate based deposit accumulation on the aftertreatment device.

14. The method of claim 6, wherein the regeneration parameters providing the regeneration event indication include at least one of: a temperature of the aftertreatment device exceeding a threshold; a pressure drop across the aftertreatment device exceeding a threshold; a pressure at an inlet to the aftertreatment device exceeding a threshold; a time elapsed since a last regeneration event; an aftertreatment device loading condition exceeding a threshold; an amount of particulate matter emitted from the engine since a last regeneration event exceeding a threshold; and an ammonia-sulphate deposit amount exceeding a threshold.

15. The method of claim 6, wherein the prioritizing of the selection is made in response to engine operating conditions.

16. The method of claim 6, wherein the selected operating mode includes reducing the charge flow to the plurality of cylinders.

17. The method of claim 16, wherein reducing the charge flow includes at least one of: closing an intake throttle in the intake system; closing an exhaust throttle in the exhaust system; opening a wastegate of a turbine in the exhaust system; and adjusting an inlet to a variable geometry turbine in the exhaust system.

18. The method of claim 6, wherein operating the engine to obtain the target condition further comprises heating the exhaust gas with a heater operated by the engine.

19. The method of claim 18, wherein the selected operating mode includes increasing the output of at least one of the speed and torque of the engine to operate the heater.

20. The method of claim 6, wherein the aftertreatment device includes a particulate filter.

21. The method of claim 20, wherein the aftertreatment device further includes an oxidation catalyst upstream of the particulate filter.

22. The method of claim 6, wherein the selected operating mode includes retarding the combustion phasing in the subset of the plurality of cylinders.

23. The method of claim 22, wherein retarding the combustion phasing includes adding one or more additional fuel injection events to a normal fuel injection event.

24. The method of claim 22, wherein fuelling the subset of the plurality of cylinders includes deactivating a remaining number of the plurality of cylinders.

25. The method of claim 6, wherein the selected operating mode includes dosing hydrocarbons upstream of an oxidation catalyst in the exhaust system and the aftertreatment device.

26. The method of claim 25, wherein dosing hydrocarbons includes external dosing of hydrocarbons into the exhaust system.

27. The method of claim 25, wherein fuelling the subset of the plurality of cylinders includes deactivating fuelling in a remaining number of the plurality of cylinders in response to the torque request, and dosing hydrocarbons includes in-cylinder dosing of hydrocarbons in at least a portion of the remaining number of the plurality of cylinders.

28. The method of claim 27, wherein in-cylinder dosing of hydrocarbons occurs during an intake stroke, early in a power stroke, or early in a compression stroke of a piston in the portion of the remaining number of the plurality of cylinders to avoid combustion of the hydrocarbons.

29. The method of claim 27, wherein in-cylinder dosing of hydrocarbons occurs late in a power stroke of a piston in the portion of the remaining number of the plurality of cylinders to avoid combustion of the hydrocarbons.

* * * * *